US007820041B2

(12) United States Patent
Hilton et al.

(10) Patent No.: US 7,820,041 B2
(45) Date of Patent: Oct. 26, 2010

(54) DRAIN COVER

(75) Inventors: Brooks Hilton, Oxnard, CA (US); M Reza Mirzaei, Agoura Hills, CA (US); Frank Hinjosa, Santa Paula, CA (US)

(73) Assignee: Waterways Plastics, Inc., Oxnard, CA (US)

( * ) Notice: Subject to any disclaimer, the term of this patent is extended or adjusted under 35 U.S.C. 154(b) by 94 days.

(21) Appl. No.: 12/322,050

(22) Filed: Jan. 27, 2009

(65) Prior Publication Data

US 2010/0187169 A1 Jul. 29, 2010

(51) Int. Cl.
*E04H 4/00* (2006.01)

(52) U.S. Cl. ..... 210/163; 210/167.16; 210/474; 210/498; 4/504; 4/507; 4/292

(58) Field of Classification Search ..... 210/163, 210/164, 166, 167.16, 474, 498; 4/496, 504, 4/507, 509, 292
See application file for complete search history.

(56) References Cited

U.S. PATENT DOCUMENTS 4,658,449 A * 4/1987 Martin ..... 210/163
5,734,999 A * 4/1998 Nicholas ..... 4/507
6,397,408 B1 * 6/2002 Veloskey et al. ..... 4/504
6,453,482 B1 * 9/2002 Mullings ..... 4/507
6,615,417 B1 * 9/2003 Newhard ..... 4/507
6,751,814 B2 * 6/2004 Mattson et al. ..... 4/504
7,346,938 B2 * 3/2008 Mattson et al. ..... 4/507
7,419,588 B2 * 9/2008 Lawson ..... 210/164
2006/0015997 A1 * 1/2006 Barnes ..... 4/507
2007/0180604 A1 * 8/2007 Griffin et al. ..... 4/507
2007/0180605 A1 * 8/2007 Griffin et al. ..... 4/507
2010/0050335 A1 * 3/2010 Baker ..... 4/504
2010/0140192 A1 * 6/2010 Hilton et al. ..... 4/507

* cited by examiner

*Primary Examiner*—Christopher Upton
(74) *Attorney, Agent, or Firm*—Sandy Lipkin

(57) ABSTRACT

A uniquely designed drain cover for swimming pools, spas, whirlpools and the like that is non-flat and clover shaped containing three or more "leaves" that provides for strengthened rigidity, increased protection against hair and body entrapment and that is connected to the sump through ribs that run across the body of the drain cover that allow for securing the drain cover to the sump through these ribs in addition to the perimeter providing for greater anti-deflection properties and anti-vortexing properties. Apertures found on the surface of the cover and along the perimeter add to the anti-deflection and anti-vortexing properties of the cover.

5 Claims, 3 Drawing Sheets

DRAIN COVER

BACKGROUND OF THE INVENTION

1. Field of the Invention

The present invention relates generally to the field of drains for swimming pools, spas and whirlpool baths and more particularly to an improved drain shape and design that reduces the likelihood of entrapment of a person's hair and body parts.

2. Description of the Prior Art

In artificial bodies of water designed for use by humans, such as swimming pools, spas and whirlpools, it is standard to include a filter to remove debris from the water and keep the water clean for use. In a typical pool or spa, a drain or suction outlet is located on the floor or in the wall of the pool or spa. The drain provides a location for the water inside of the pool or spa to be removed from the main body of water and passed through a suction line that is connected to a suction pump.

Often, a trap for debris is housed between the suction line and the pump to catch larger debris before the water enters a filter. Once the water has been filtered, it is returned to the pool or spa. The suction created by the suction line can be strong enough to entrap body parts or hair of persons proximate the drain and can ultimately end in drowning or severe injury.

Typical drain covers have been flat and square shaped and attaching to the suction line on the perimeter of the square. One problem with the traditionally square-shaped, flat drain covers is that due to the attachment only at the perimeter of the square, when loads are applied to the drain cover, there has been excessive deflection of the cover leading to damage of the drain cover and its connecting fasteners, thereby increasing the entrapment hazard to persons near the drain.

The instant invention seeks to provide a drain cover that overcomes the shortcomings of the prior art.

SUMMARY OF THE INVENTION

The preferred embodiment of the present invention teaches an improved sump and drain cover for an artificial body of water such as a pool, spa and the like comprising a sump with an enclosing body; three or more vertical supports located in the sump; a non-flat cover to attach to the sump, the non-flat cover having three or more appendages creating a non-circular and non-square shape and having a substantially concave shape relative to the sump wherein the non-flat cover has a top surface and a perimeter surface that extends in a vertical direction toward the sump; three or more load bearing members extending downward from the non-flat cover, each of the three or more load bearing members to connect with the three or more vertical supports located in the sump; a first plurality of apertures on the top surface of the non-flat cover; and a second plurality of apertures on the perimeter surface of the non-flat cover.

The above embodiment can be further modified by defining that the first plurality of apertures run substantially parallel to each other.

The above embodiment can be further modified by defining that the second plurality of apertures run substantially parallel to each other.

The above embodiment can be further modified by defining that the non-flat cover is attached to the sump through three or more fasteners that extend through holes in the perimeter of the cover and attach to the enclosing body of the sump.

The above embodiment can be further modified by defining that the fasteners attach first to a securing frame and second to the enclosing body of the sump.

BRIEF DESCRIPTION OF THE DRAWINGS

This invention can better be understood by reference to the drawings, provided for exemplary purposes, and in which.

DETAILED DESCRIPTION OF A PREFERRED EMBODIMENT

Figure 1:
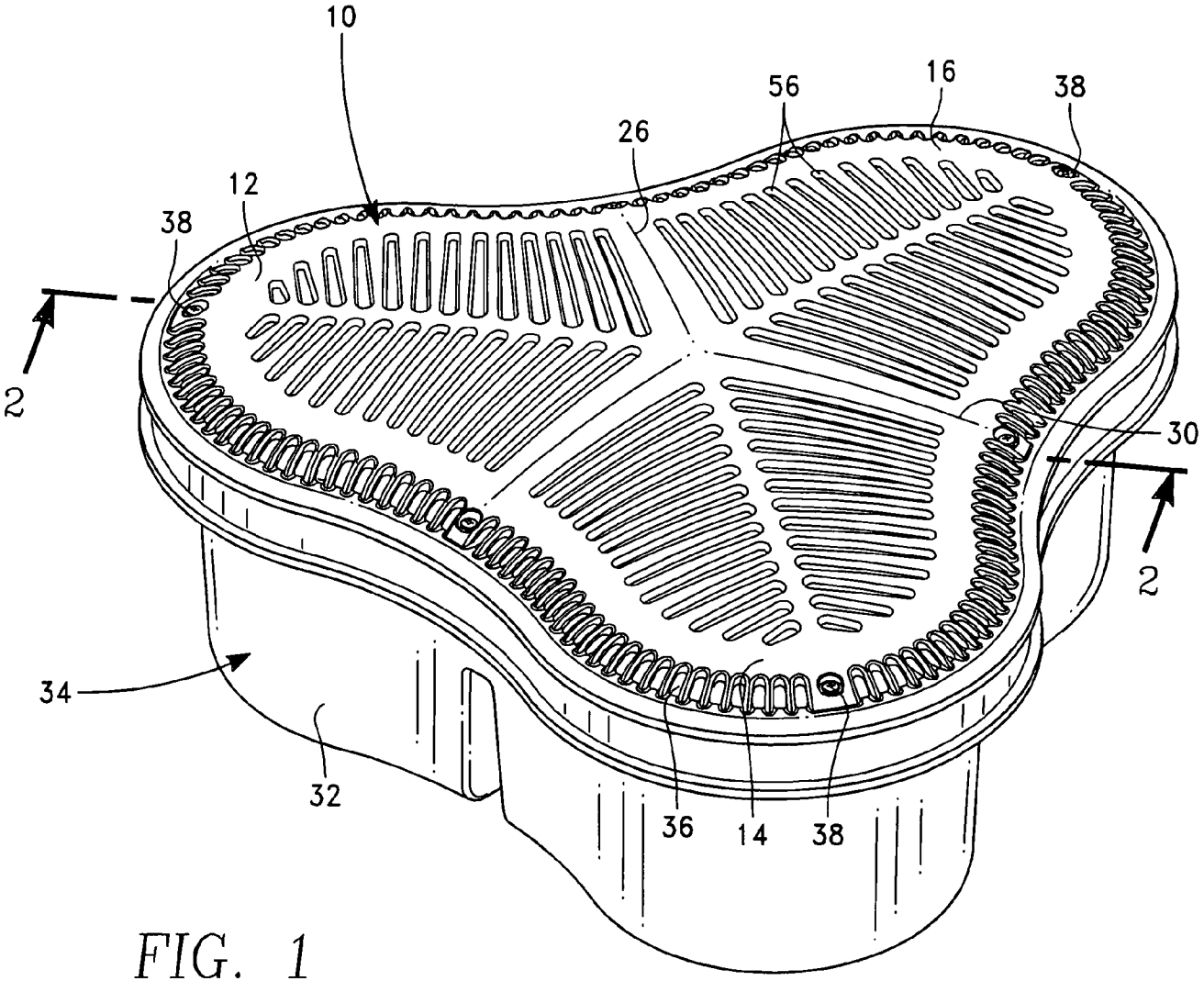
FIG. 1 is a perspective view of the improved drain cover of the instant invention.

The following is a list of the reference numbers for easy reference when referring to the drawings:

10 cover, grate
12 first leaf of clover
14 second leaf of clover
16 third leaf of clover
18 second rib in sump (corresponding to demarcation line 28 on surface of grate and vertical support 48 on underside of grate)
20 third rib in sump (corresponding to demarcation line 30 on surface of grate and vertical support 58 on underside of grate)
22 first rib in sump (corresponding to demarcation line 26 on surface of grate and vertical support 50 on underside of grate)
24 interior of sump
26 first demarcation on surface of grate corresponding to vertical support 50 on underside of grate)
28 second demarcation on surface of grate corresponding to vertical support 48 on underside of grate)
30 third demarcation on surface of grate corresponding to vertical support 58 on underside of grate)
32 exterior surface of sump
34 sump body
36 apertures on perimeter of grate
38 fasteners
40 inserts for fasteners
42 securing frame
44 holes in grate
46 holes in securing frame
48 second vertical rib (corresponding to second demarcation on surface of grate and vertical support 18 in sump)
50 first vertical rib (corresponding to first demarcation on surface of grate and vertical support 22 in sump)
52 off center hole in sump
54 center hole in sump
56 surface apertures on surface of grate
58 third vertical rib (corresponding to third demarcation on surface of grate and vertical support 20 in sump)

The instant invention is a non-flat drain cover grate that has a shape that radically departs from the traditional square shape. A perspective view is shown in FIG. 1. The shape of the cover 10 (and the overall sump body) is generally defined as a clover shape having three "leaves," 12, 14, 16 but it is not limited to just three "leaf" portions. The design incorporates three or more load bearing ribs 18, 20, 22 (see FIG. 3) inside the interior 24 of the sump 34 that mate with three or more matching vertical ribs with corresponding demarcation lines 26, 28, 30 shown here on the surface of the mating grate 10. As a result, loads on the grate surface 10 are transferred through the grate ribs 26, 28, 30 to the matching sump load bearing ribs 18, 20, 22 which are eventually distributed to the exterior surface of the sump 32, backed with concrete.

Because of the enhanced overall rigidity of the drain cover 10 as well as improved load distribution due to the design, the cover 10 provides for higher vertical and shear load strength and minimizes the grate deflection under the load.

Figure 4:
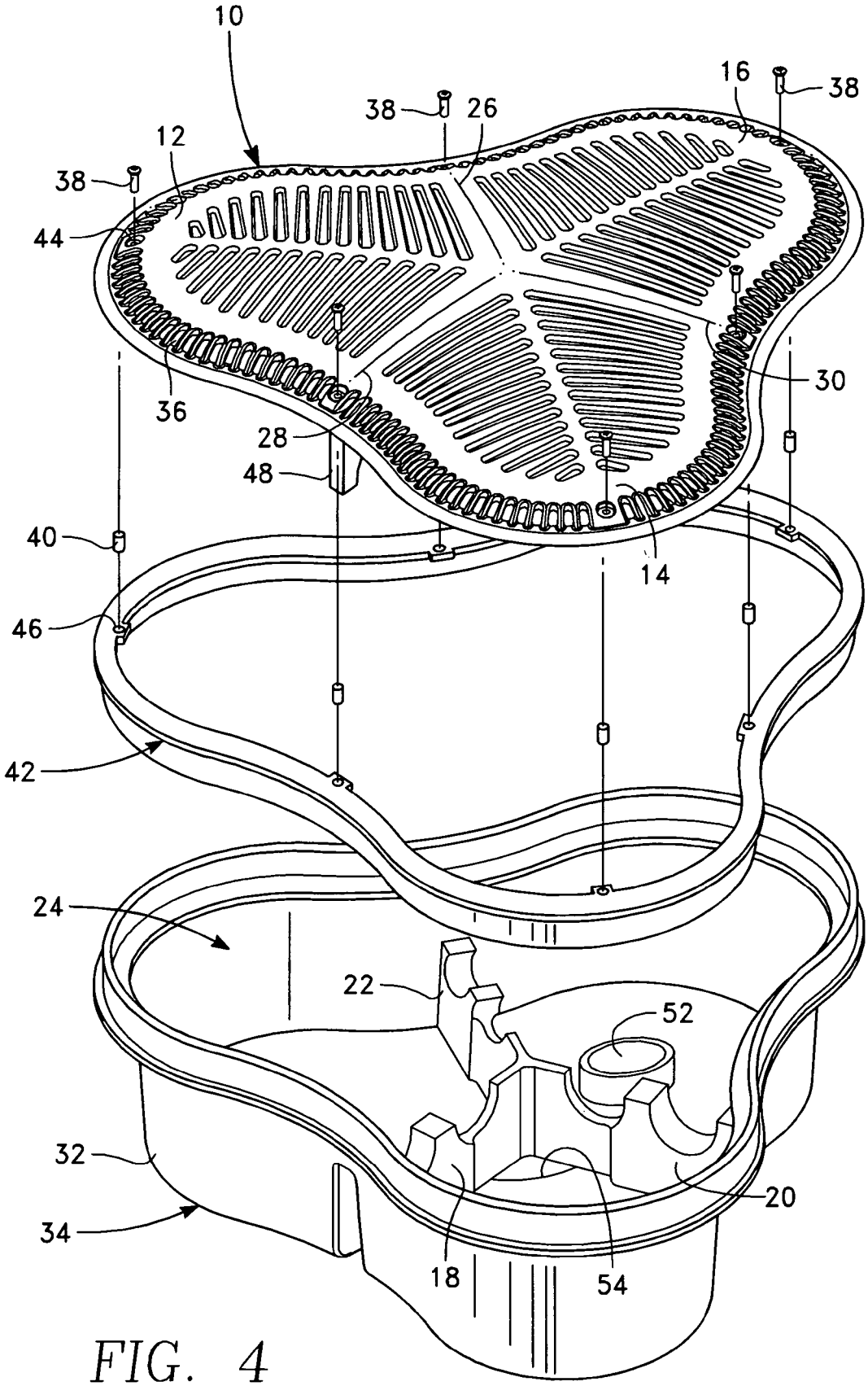
FIG. 4 is an exploded view of the cover, frame and body of the drain and sump of the instant invention.

Furthermore, the clover design provides for a higher ratio of aperture to the total surface area of the suction fitting. As a result, it minimizes the average speed of the water through suction openings and maximizes the flow-rate capacity of the suction fitting, while adhering to federal regulations designed to minimize hair entrapment. Additionally, the unique geometry of the grate provides a unique convex profile of the grate surface and geometry of openings that conform to federal regulations designed to minimize body entrapment. As can be seen in FIGS. 1 and 4, the grate cover 10 has a series of apertures 56 along the top surface of the cover 10 as well as another series 36 along the perimeter of the cover 10.

There are ample openings 36 in the perimeter of the suction grate 10. This combined with the clover geometry of the grate perimeter and the incorporation of special ribs 18, 20, 22 in the sump 34 with the vertical ribs 48, 50, 58 on the underside of the grate 10 leads to a minimum of vortexing. The grate 10 is more securely housed to the sump 34 due to its unique clover geometry. This secure connection provides increased rigidity and prevents subsequent loosening of fasteners 38 under possible field forces and deflections. The exploded view in FIG. 4 shows the fasteners 38 fastening through holes 44 in the perimeter of the grate 10 into inserts 40 that fit into holes 46 in a securing frame 42 that attaches to the sump body 34. Visible in FIG. 4 is the vertical rib 48 that extends on the underside of the grate 10 that corresponds to the demarcation on the top of the grate 10 as 28. Demarcation 26 and demarcation 30 also have corresponding vertical ribs (not shown in this figure, but are illustrated in FIG. 2) that fit into the mating supports 18, 20, 22 found in the interior 24 of the sump 34.

Figure 2:
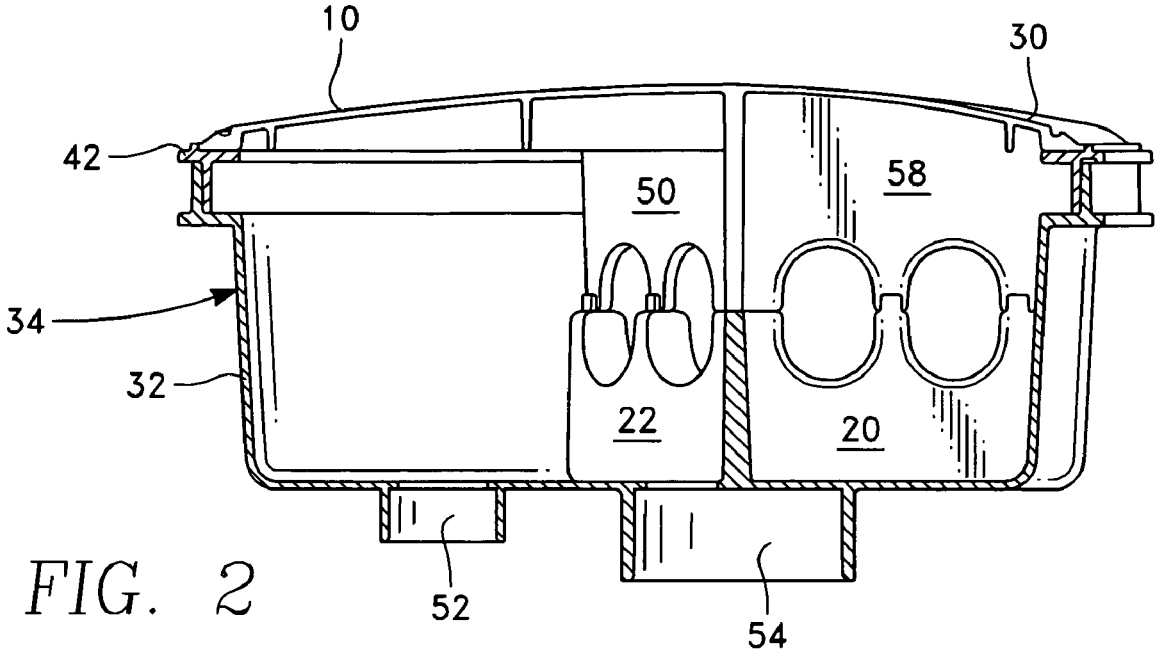
FIG. 2 is taken along the line 2-2 in FIG. 1.

FIG. 2 shows a side view of the interior of the sump 24 with the grate 10 in place. In this view one of the vertical ribs 58 corresponding to demarcation 30 on the grate 10 seen in FIG. 1 fits in place over the vertical rib 20 found in the sump 34. Likewise a vertical support 50 is shown that corresponds to vertical demarcation 26 in FIG. 1 and attaches to vertical support 22 as shown in FIG. 4.

Figure 3:
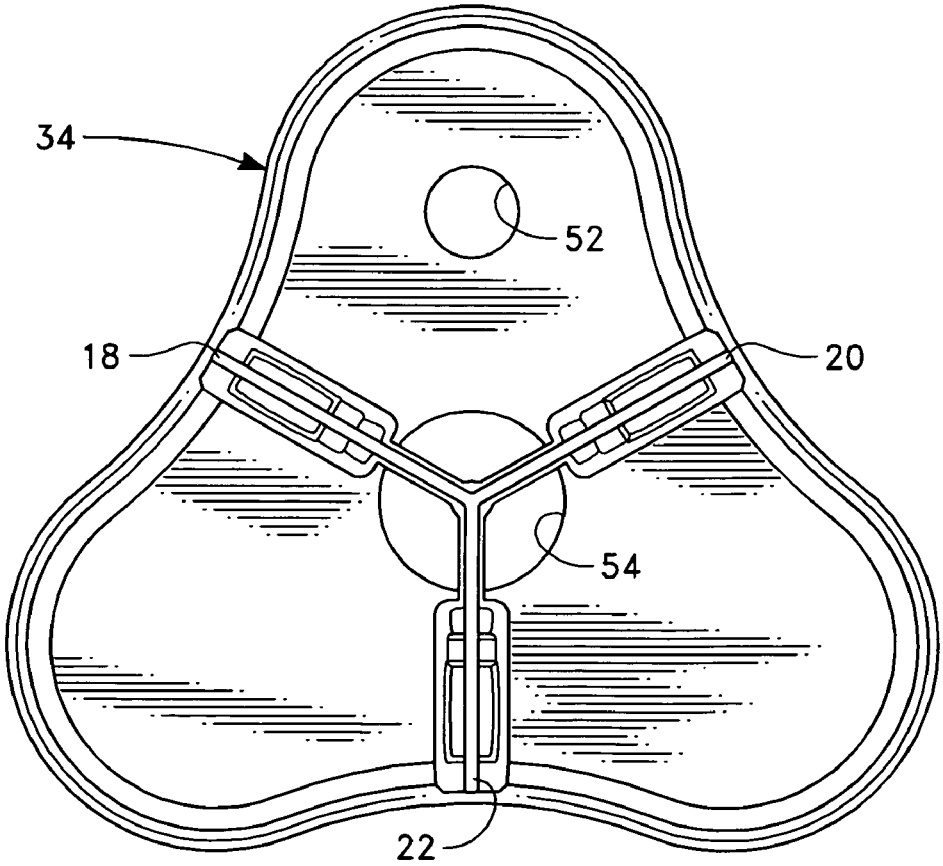
FIG. 3 is a bottom view of the drain and sump of the instant invention.

FIG. 3 shows a bottom view of the sump where the position of the vertical supports 18, 20, 22 are easily seen in relation to each other. Also shown are the standard holes 52, 54 that allows for the flow of water in and out of the sump.

Additionally, the unique design of the cover provides aesthetic features for the suction fitting for swimming pools and water parks that is not achieved with a traditionally square-shaped cover.

The illustrations and examples provided herein are for explanatory purposes only and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An improved sump and drain cover for an artificial body of water such as a pool, spa and the like comprising
   - a sump with an enclosing body;
   - three or more vertical supports located in said sump;
   - a non-flat cover to attach to said sump, said non-flat cover having three or more appendages creating a non-circular and non-square shape and having a substantially convex shape relative to said sump wherein said non-flat cover has a central top surface and a perimeter surface that extends downwardly in a vertical direction toward said sump;
   - three or more load bearing members extending downward from said non-flat cover, each of said three or more load bearing members to connect with said three or more vertical supports located in said sump;
   - a first plurality of apertures on said top surface of said non-flat cover; and
   - a second plurality of apertures on said perimeter surface of said non-flat cover.

2. The improved sump and drain cover as defined in claim 1 wherein said first plurality of apertures run substantially parallel to each other.

3. The improved sump and drain cover as defined in claim 1 wherein said second plurality of apertures run substantially parallel to each other.

4. The improved sump and drain cover as defined in claim 1 wherein said non-flat cover is attached to said sump through three or more fasteners that extend through holes in said perimeter of said cover and attach to said enclosing body of said sump.

5. The improved sump and drain cover as defined in claim 4 wherein said fasteners attach first to a securing frame and second to said enclosing body of said sump.

* * * * *